United States Patent [19]

Shih-Li

[11] 4,345,335

[45] Aug. 24, 1982

[54] WEBBED GLOVE FOR SWIMMING USE

[76] Inventor: Chao Shih-Li, 10-4 Fl., No. 62, Chang Chun Rd., Taipei, Taiwan

[21] Appl. No.: 159,820

[22] Filed: Jun. 16, 1980

[51] Int. Cl.[3] ..... A41D 19/00; A63B 31/02

[52] U.S. Cl. ..... 2/161 A; 441/57

[58] Field of Search ..... 2/161 A, 16; 9/308

[56] References Cited

U.S. PATENT DOCUMENTS

| | | | |
|---|---|---|---|
| 2,004,684 | 6/1935 | Bell | 9/308 |
| 4,058,863 | 11/1977 | Ferdico | 9/308 |
| 4,195,365 | 4/1980 | Eyman et al. | 9/308 |

FOREIGN PATENT DOCUMENTS

| | | | |
|---|---|---|---|
| 497312 | 11/1953 | Canada | 9/308 |
| 159427 | 1/1933 | Switzerland | 9/308 |

*Primary Examiner*—Doris L. Troutman

*Attorney, Agent, or Firm*—Cushman, Darby & Cushman

[57] ABSTRACT

An improved webbed swimming glove in which the finger sheaths have cutting holes on sheath end. Webs are provided between adjacent finger sheaths for facilitating swimming or diving use. A similar glove in which the finger sheaths terminate in a tip structure surrounding a hole is also disclosed. The sheath of index finger may be formed as a truncated sheath facilitate triggering a gun for military or a frogman's use.

3 Claims, 4 Drawing Figures

WEBBED GLOVE FOR SWIMMING USE

BACKGROUND OF THE INVENTION

A webbed swimming glove has already been disclosed by the present inventor. Such a webbed glove has been granted Taiwan patent as Utility Model of No. 7266. The glove described in the Taiwan patent provides webs between adjacent finger sheaths so that the glove makes the swimming quicker and easier. It may also replace the traditional diving flipper having greater weight and volume. However, Taiwan Utility Model 7266 describes a closed finger sheath so that the water entering the sheath, accumulates therein. This adversely affect swimming action and may also cause discomfort for the swimmer. Meanwhile, the glove cannot easily be removed as there is no air passage through said glove and sheath.

The present inventor has recognized these defects and eliminated to them with the present invention.

SUMMARY OF THE INVENTION

One object of the present invention is to provide an improved webbed swimming glove in which each finger sheaths has a hole on, its respective end for discharging water in said glove, thus allowing comfortable wearing and easier removing.

Another object of the present invention is to provide an improved webbed swimming glove in which the end of each finger sheath is provided with a tip, the tip having a hole in its center, for preventing the fingernail from tearing the sheath.

Another object of the present invention is to provide an improved webbed swimming glove in which the sheath of index finger has been formed as truncated sheath to expose the finger to facilitate a gun for military use.

DESCRIPTION OF THE PREFERRED EMBODIMENTS

Figure 1:
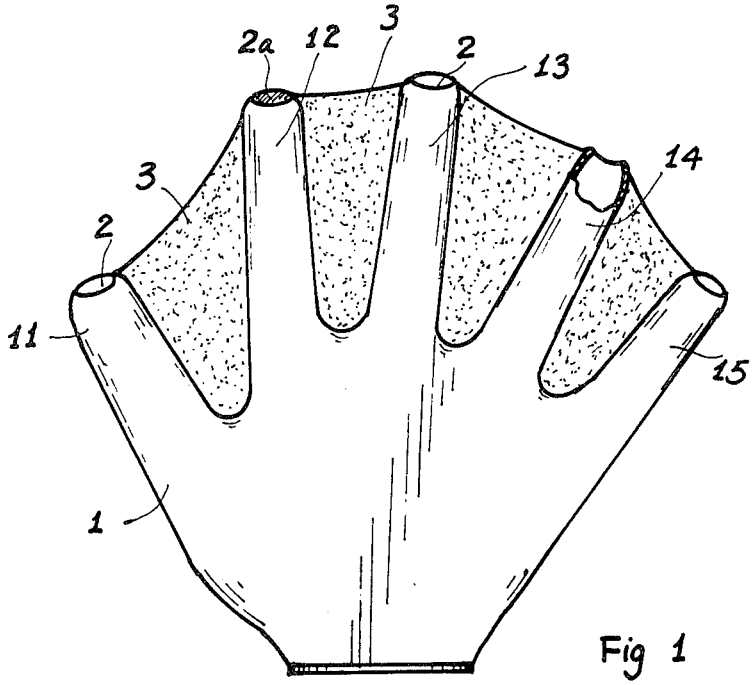
FIG. 1 is an illustration showing one preferred embodiment of the present invention.

As shown in FIG. 1, the webbed glove 1 of the present invention has five finger sheaths, that are, sheath of thumb, sheath 12 for the index finger sheath, 13 for the middle finger sheath of 14 for the ring finger and sheath 15 for the little finger. Atop each finger sheath, a hole 2 is formed thereon. Web 3 is provided between each pair of adjacent sheaths.

The cutting hole 2 formed on the end of each sheath may discharge the water accumulated in or entering said glove 1. However, the material surrounding hole 2 as shown in FIG. 1 may be torn accidently by the finger. Hence, the present inventor also discloses the improved glove as shown in FIG. 2.

Figure 2:
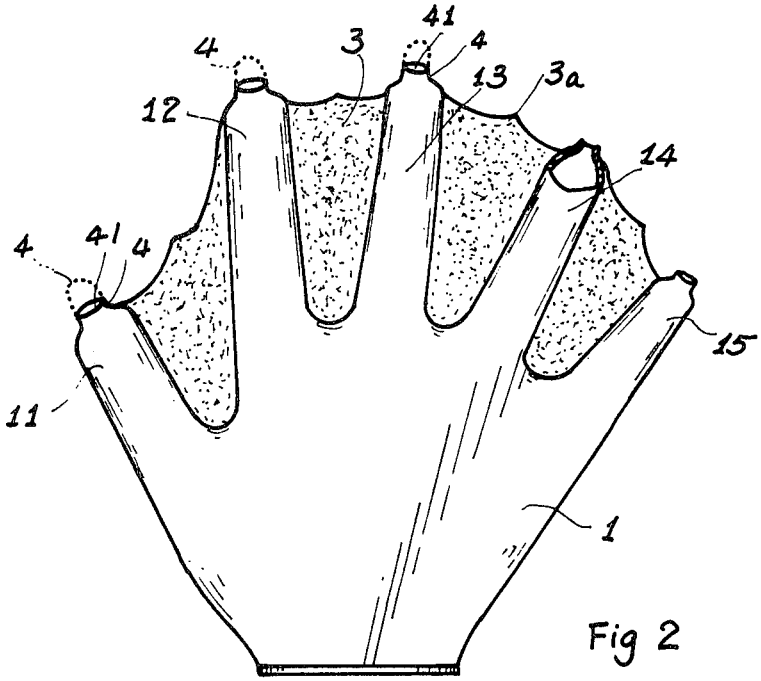
FIG. 2 is another illustration of the preferred embodiment derived from FIG. 1.

A sheath tip 4 having a smaller diameter than the sheath is extended from the sheath end as in phantom shown in FIG. 2. Said tip 4 is then cut using scissors or other tools to form a tip hole 41. The hole 41 is smaller than that hole 2 as shown in FIG. 1. Once its end has been thus severed, tip 4 has a nipple-like shape which surrounds hole 41. It alleviates the stress or strain as the finger is forced into said sheath end. Such a glove will not be easily broken and its service life will thus be prolonged.

The web 3 may also have a central extension 3*a* as shown in FIG. 2. However, the present invention is not limited to a specific shape of said web 3.

Figure 4:
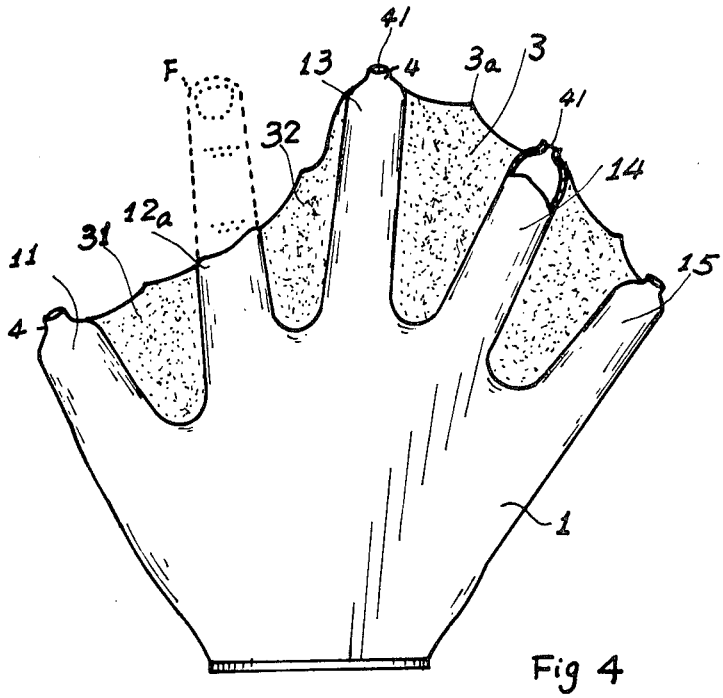
FIG. 4 is the illustration of another preferred embodiment derived from FIG. 3.
Figure 3:
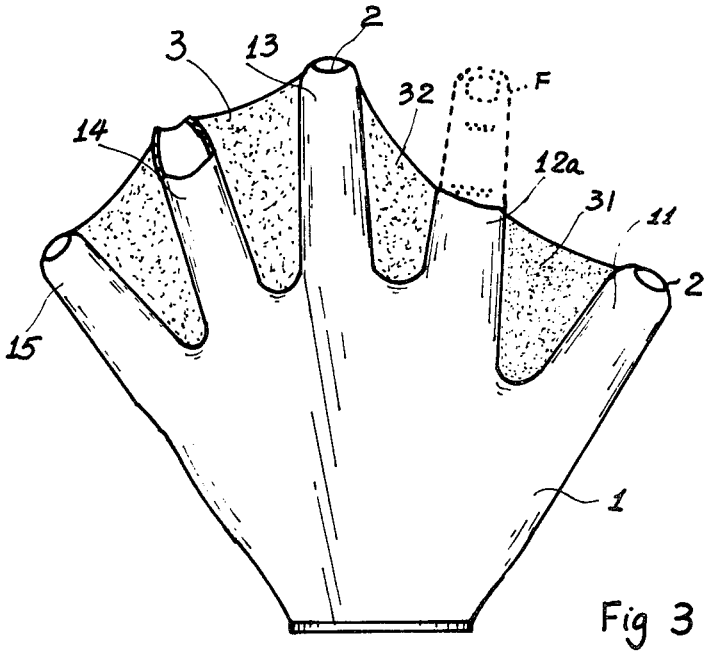
FIG. 3 is an illustration of another preferred embodiment of the present invention.

FIGS. 3 and 4 show another preferred embodiment of glove 1. The sheath for index finger has been made as truncated sheath 12*a*. Shortened webs 31 and 32 are respectively provided between sheath 12*a* and sheaths 11 and 13 respectively. Thus, the upper portion of the index finger exposed, thus making it easier for the wearer to use a pistol or other weapon having a trigger. Webs 31 and 32 are only slightly shortened so as not to materially affect the swimming performance enhancement of the glove.

The present invention may be made integratedly of plastic or rubber moulding. The extended edge 2*a* of cutting hole 2 atop said finger sheath as shown in FIG. 1 may be eliminated by the improved sheath tip 4 as shown in FIG. 2 as described above.

I claim:

1. A webbed swimming glove comprising:

a plurality of sheaths each defining a sheath cavity for accommodating a digit on a hand, each of said sheaths including an end portion terminating in an elongated sheath tip extending away from said end portion and defining an elongated aperture substantially smaller in cross-section than said sheath-cavity; and a web attached to each adjacent pair of said sheaths.

2. A webbed swimming glove as claimed in claim 1 in which the length of said sheath for the index finger is truncated to expose and free the finger tip, finger cushion and at least that portion of the phalanx above the second articulating joint of the index finger inserted therethrough.

3. A webbed swimming glove as claimed in claim 2 in which said webs attached to said truncated index finger sheath are themselves truncated along their respective sides adjoining said truncated index finger sheath thus making the length of said side substantially the same as said length of said truncated index finger sheath.

* * * * *